US005311692A

United States Patent [19]

Blaser

[11] Patent Number: 5,311,692

[45] Date of Patent: May 17, 1994

[54] REMOVABLE FIREARM LOCK

[75] Inventor: Horst Blaser, Isny im Allgäu, Fed. Rep. of Germany

[73] Assignee: Dynamit Nobel AG, Troisdorf, Fed. Rep. of Germany

[21] Appl. No.: 911,111

[22] Filed: Jul. 9, 1992

Related U.S. Application Data

[63] Continuation of Ser. No. 640,812, Jan. 14, 1991, abandoned.

[30] Foreign Application Priority Data

Jan. 13, 1990 [DE] Fed. Rep. of Germany ..... 4000819

[51] Int. Cl.[5] ..... F41A 9/15

[52] U.S. Cl. ..... 42/42.01; 42/43; 42/69.01; 42/75.03

[58] Field of Search ..... 42/41, 42.01, 42.02, 42/42.03, 43, 44, 69.01, 69.02, 75.03; 89/127

[56] References Cited

U.S. PATENT DOCUMENTS

| | | | |
|---|---|---|---|
| 569,244 | 10/1896 | Sill | 42/41 |
| 793,875 | 7/1905 | Godbout | 42/43 |
| 3,766,677 | 10/1973 | Waddell | 42/75.03 |
| 4,283,873 | 8/1981 | McIntyre | 42/41 |
| 4,452,001 | 6/1984 | Compton | 42/69.01 |
| 4,472,899 | 9/1984 | Joelsson et al. | 42/42.01 |
| 4,744,166 | 5/1988 | Mattarelli | 42/69.01 |

FOREIGN PATENT DOCUMENTS

| | | | |
|---|---|---|---|
| 0228548 | 7/1987 | . | |
| 1903798 | 8/1970 | Fed. Rep. of Germany . | |
| 1939939 | 2/1971 | Fed. Rep. of Germany . | |
| 2237794 | 3/1973 | Fed. Rep. of Germany | 42/43 |
| 1040401 | 10/1953 | France | 42/43 |
| 82538 | 1/1964 | France | 42/42.01 |
| 462670 | 10/1968 | Switzerland | 42/41 |

*Primary Examiner*—Stephen C. Bentley
*Attorney, Agent, or Firm*—Antonelli, Terry, Stout & Kraus

[57] ABSTRACT

In a multiple-barrel firearm with removable lock housing, the two axially moveable strikers are arranged in superposed relationship, preferably being angular and provided with grooves or edges; this arrangement permits, even in case of only one solid sidewall, a favorable guidance of the strikers and contributes considerably toward making the lock housing very narrow. Since, in this firearm, the movement of a cocking bar just as the movement of firing pins takes place approximately in parallel to the movement of the strikers, the advantage is obtained in addition to a relatively simple structure that the energy for cocking coil springs guided by means of guide pins can be at a minimum as well. The guide pins connected with the strikers also take over safety functions.

2 Claims, 2 Drawing Sheets

REMOVABLE FIREARM LOCK

This application is a continuation application of application Ser. No. 640,812, filed Jan. 14, 1991, now abandoned.

BACKGROUND OF THE INVENTION

This invention relates to a sport or hunting firearm with at least one barrel, each barrel being associated with a firing pin driven by a striker, with a lock housing comprising a triggering arrangement, and with at least one striker wherein the at least one striker is guided in an axially movable fashion and—if several strikers are provided, the strikers are arranged in superposed relationship, with a cocking device comprising a cocking bar, and with a safety device.

In conventional multiple-barrel firearms, the strikers are usually arranged so that they hit radially and are in side-by-side relationship. On account of this relatively broad construction of the lock housing, the stock of the firearm is weakened in the lock region.

A firearm lock for a multiple-barrel break-open firearm has been known from DOS 1,903,798 wherein strikers, cocking elements, and firing pins are arranged in parallel to one another and can be moved in the same direction, and these elements, designed substantially as rotational parts, are guided in bores.

SUMMARY OF THE INVENTION

The invention has as its object a firearm such as a rifle or shotgun, of the type heretofore described wherein the at least one striker exhibits, in cross section, an angular, substantially rectangular shape and is accommodated in a lock housing that can be removed from the breech casing.

In addition to presenting the special advantage that only a relatively narrow lock housing is required, this arrangement of the strikers affords further advantages with regard to safety and manufacturing capability.

Preferably, the parallel movement of the strikers in the lock housing takes place approximately unidirectionally with the movement of the firing pins. Thereby, the losses in energy transmission are minimized and a relatively low striker energy is sufficient. In such an arrangement, the striking distance is short, which is accompanied by rapid ignition. On account of a lower energy, preferably stored in a coil spring, the force to be expended for cocking is correspondingly less and the trigger resistance is lower.

The strikers, having an angular, preferably rectangular cross section, with elevations and indentations, preferably with grooves or edges at the striker and corresponding edges or grooves at the lock housing, can be guided in the lock housing in a simple way and can be manufactured with an advantageous technique. It may be sufficient for the lock housing to exhibit only one sidewall in parallel to the plane of the strikers because the strikers can be adequately guided by even one sidewall. Without loss of precision and stability, the lock housing can thus be designed to be particularly narrow.

In the rifle according to this invention, the cocking of the cocking elements can take place directly by a linear motion of the cocking bar without any intermediate elements; the movement of the cocking bar and the motion of the strikers take place approximately in parallel. Another preferred embodiment is characterized in that the end of the cocking bar presses, during cocking, on the lower striker and cocks same thereby, and that an extension is arranged at the upper striker extending laterally over the lower striker in such a way that the end of the cocking bar during cocking also presses on this extension and therefore also cocks the upper striker. In this way, the simultaneous cocking of the superimposed strikers can be achieved without special expenditure and without any additional rerouting means or transmission arrangements.

A further development of the invention is characterized in that a guide pin for guiding a coil spring driving the striker is mounted at each striker.

An advantageous embodiment of the rifle with the removable lock housing is characterized in that bores are provided in the strikers, the coil springs partially projecting into these bores. In this way, a compact structure can be obtained even in case of angular strikers.

The guide pin connected with the striker is suitable in a special way to take over safety functions additionally thereto. It is advantageous to guide the guide pin in the rear wall (facing away from the barrel) of the lock housing and making it of such a length that it does not protrude, with the striker having been struck, out of the rear wall of the lock housing but, on the other hand, with the striker being cocked, the tip of the guide pin projects toward the rear out of the lock housing to such an extent that simple measures at the breech casing render the tips of the guide pins projecting from the lock housing capable of preventing the removal of the lock housing even if merely one guide pin still projects from the lock housing: in other words, the lock housing can be dismounted and installed only in case both strikers are uncocked.

Additionally, according to a further development of the invention, the feature can also be attained that the lock, in the dismounted condition, cannot be inadvertently cocked. This is achieved by a pressure stud which has grooves and is arranged in the lock housing somewhat offset to the plane of the guide pins in such a way that the ends of the guide pins can project out of the rear wall of the lock housing only if the guide pins can slide in the grooves of the pressure stud.

Preferably, a spring is provided acting on the pressure stud; this spring can be compressed only in the installed condition of the lock precisely to such an extent that the guide pins can slide in the grooves of the pressure stud. Thus, a maximum degree of safety is obtained by simple means.

In case—as is frequently customary—only one trigger lever is provided, a change-over means must be included for the superimposed strikers. In the firearm of this invention, two advantageous embodiments are preferred, in this connection, wherein changeover can be effected by a change-over bolt displaceable transversely to the barrel direction. Such a change-over bolt has the advantage that the shooter, once having seized the stock, need not let go of it any more for switching barrels. The transverse displacement of the change-over bolt is here transmitted, via correspondingly mutually moving surfaces, to a change-over rocker which, in turn adjusts a tumbler weight. Preferably, in one embodiment, the tumbler weight is displaceable perpendicularly to the plane of the strikers so that the tumbler weight engages only at one of the sears of the upper or of the lower striker. In another embodiment, the tumbler weight is rotatable in the plane of the strikers so that the weight engages only at one of the sears of the upper or of the lower striker.

Since the lock housing is very compact and, in particular, very narrow, the stock of the rifle or shotgun in the lock zone is not weakened. The lock housing is inserted in the breech casing in a shape-mating fashion. In order to remove the lock housing, it is merely necessary to actuate a locking pawl which clamps the lock housing in place, most advantageously on the side facing away from the at least one barrel, and which preferably should be operable only when a safety slide mounted to the topside of the breech casing has been pushed rearwardly.

BRIEF DESCRIPTION OF THE DRAWINGS

The invention is illustrated in the accompanying drawings and will be described in greater detail hereinafter. In the drawings.

DETAILED DESCRIPTION OF THE INVENTION

Figure 1:
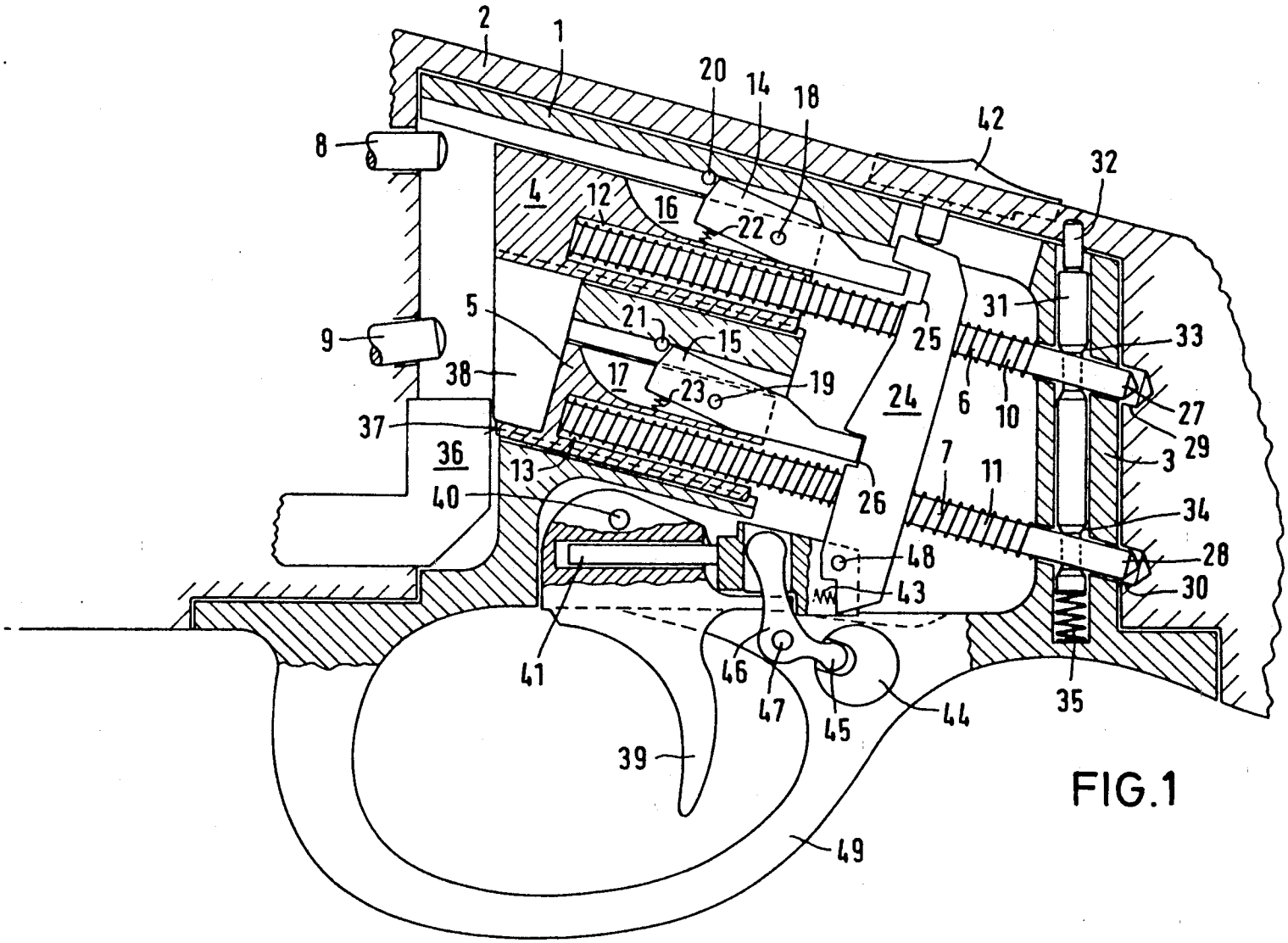
FIG. 1 shows a removable lock housing with two cocked strikers (at the end of the cocking step with the barrels being broken open)

The two figures illustrate two operative conditions wherein, to facilitate understanding, the section through the lock does not extend everywhere consistently in the plane of the strikers. The axially movable strikers of angular shape and arranged in parallel superposition are characteristic. Such a lock could also be utilized in a rifle or shotgun with three barrels if one of the two strikers, in a conventional way, were to be associated with a third barrel by means of a change-over mechanism not shown herein.

A lock housing 1 is adapted in its outer dimensions to a corresponding, approximately square breech casing 2 in the firearm. With a shape-mating connection, a single locking pawl 50 is adequate for fastening purposes; this pawl is indicated in dashed lines only in FIG. 2 in the rear wall 3 of the lock housing 1 and is arranged, in the lock housing 1, to be offset with respect to the plane of the strikers 4, 5 and/or of the pressure stud 32, which stud, in turn, is somewhat offset.

The parallel-guided strikers 4, 5, rectangular in cross section, transmit the energy stored in tensioned coil springs 6, 7 to firing pins 8, 9, respectively. The coil springs 6, 7 are, respectively, pushed over guide pins 10, 11. For reasons of compactness, the strikers 4, 5 exhibit bores 12, 13 into which the guide pins 10, 11 project. The guide pins are connected to the strikers 4, 5 at the base of the bores 12, 13. The bottom of the bore 12, 13 and the rear wall 3 of the lock housing 1 serve as the abutments for the coil springs 6, 7. For reasons of compactness, sears 14, 15 are arranged in grooves 16, 17 of the strikers 4, 5. The sears 14, 15 are mounted to be pivotable about fulcrums 18, 19 and are supported on supporting points 20, 21. The route of each striker 4, 5 toward the firing pin 8, 9 is conventionally limited by means of stops, not shown in the figure. During cocking, the sears 14, 15 engage at the supporting points 20, 21 under the action of springs 22, 23.

Upon a movement of a tumbler weight 24 perpendicularly to the direction of movement of the strikers 4, 5 (toward the top in the drawing), one of the sears 14, 15 is pivoted via one of the detents 25, 26 and thus the blockage of the respective striker 4, 5 is overcome: the respective striker 4, 5 impinges on the respective firing pin 8, 9.

The guide pins 10, 11 for the coil springs 6, 7 also take over an important safety function. The tips 27, 28 of the guide pins 10, 11 project, in the cocked condition, out of the rear wall 3 of the lock housing 1. In the breech casing 2 in the rifle, edges 29, 30 are provided which are adapted to the tips 27, 28 of the guide pins 10, 11 whereby removal of the lock housing 1 from the breech casing 2 (in the drawing toward the bottom) in the cocked condition is prevented in a simple way.

Cocking of the strikers 4, 5 in the dismounted condition is precluded by the guide pins 10, 11 in conjunction with a pressure stud 31. The pressure stud 31 is countersunk into the rear wall 3 of the lock housing 1 in such a way that it becomes possible, when the pressure stud is placed by a stud 32 adapted thereto in the breech casing 2 under pressure (in the downward direction in the drawing), for the tips 27, 28 of the guide pins 10, 11 to pass through the rear wall 3 because grooves 33, 34 in the pressure stud 31 enable the guide pins 10, 11 to slide past the "obstacle" pressure stud 31 somewhat offset from the place of the strikers 4, 5. If the pressure stud 31 were not to compress the spring 35 by the "correct" dimension, then the grooves 33, 34 in the lock housing 1 would be located too "high" or too "low", and cocking of the strikers 4, 5 until the sears 14, 15 are engaged would be impossible.

As soon as the lock housing 1 has been removed from the breech casing 2 (which, as explained above, is possible only if both strikers 4, 5 are uncocked), the pressure stud 31 escapes in the upward direction on account of the spring 35. Upon insertion of the lock housing 1, this safety mechanism is deactivated without any special manipulation by the shooter.

Cocking of the strikers 4, 5 takes place by a cocking bar 36. During breaking open of the barrels, the cocking bar 36 moves toward the lock housing 1 and during this step pushes he front side 37 of the lower striker 5—in case it had been uncocked—against the coil springs 7 into the breech housing 1 until the sear 15 engages behind the supporting point 21. In this lock construction, the cocking of the striker by the cocking bar 36 is especially advantageous from the viewpoint of force expenditure, and is mechanically very simple. (FIG. 1)

Both strikers, or each striker individually, can be seized by the cocking bar 36 for cocking purposes, on account of an extension 38 at the upper striker 4 extending over the lower striker 5 in such a way that the forward surface **37*a* of the extension 38 lies at the same level as the forward surface 37 of the lower striker 5. Consequently, both strikers 4, 5** when the barrels are broken open can again be brought into the cocked position insofar as they have not remained in the cocked condition.

The triggering of the strikers 4, 5 takes place by way of a trigger lever 39 about a fulcrum 40. Upon operation of the trigger lever 39, a trigger arm 41 arranged to be longitudinally displaceable in a bore of the trigger lever 39 is lifted up, entraining, in turn, the tumbler weight 24. In FIG. 1, the tumbler weight 24 is blocked by the safety slide 42; when the slide is pushed into a central position (FIG. 2), it is possible in FIG. 1 as well as in FIG. 2, upon operation of the trigger lever 39 about the fulcrum 40, to lift in each case the sear 15 by the detent 26. As a result, the sear 15 is not blocked by the supporting point 21: the striker 5 impinges, driven by the coil spring 7, onto the lower firing pin 9. It can be readily seen that, in this arrangement, the direction of movement of the striker 5 does not deviate substantially from the direction of motion of the firing pin 9 so that there occurs hardly any loss in transmitted energy.

As soon as the lower striker 5 has been propelled toward the firing pin 9, the tumbler weight 24 can tilt somewhat about a fulcrum 48 under the pressure of a spring 43, and the upper detent 25 at the tumbler weight 24 is brought into shape-mating connection with the upper sear 14 so that the top detent 25, upon a renewed movement of the tumbler weight 24, will eliminate the blockage of the upper striker 4.

Figure 2:
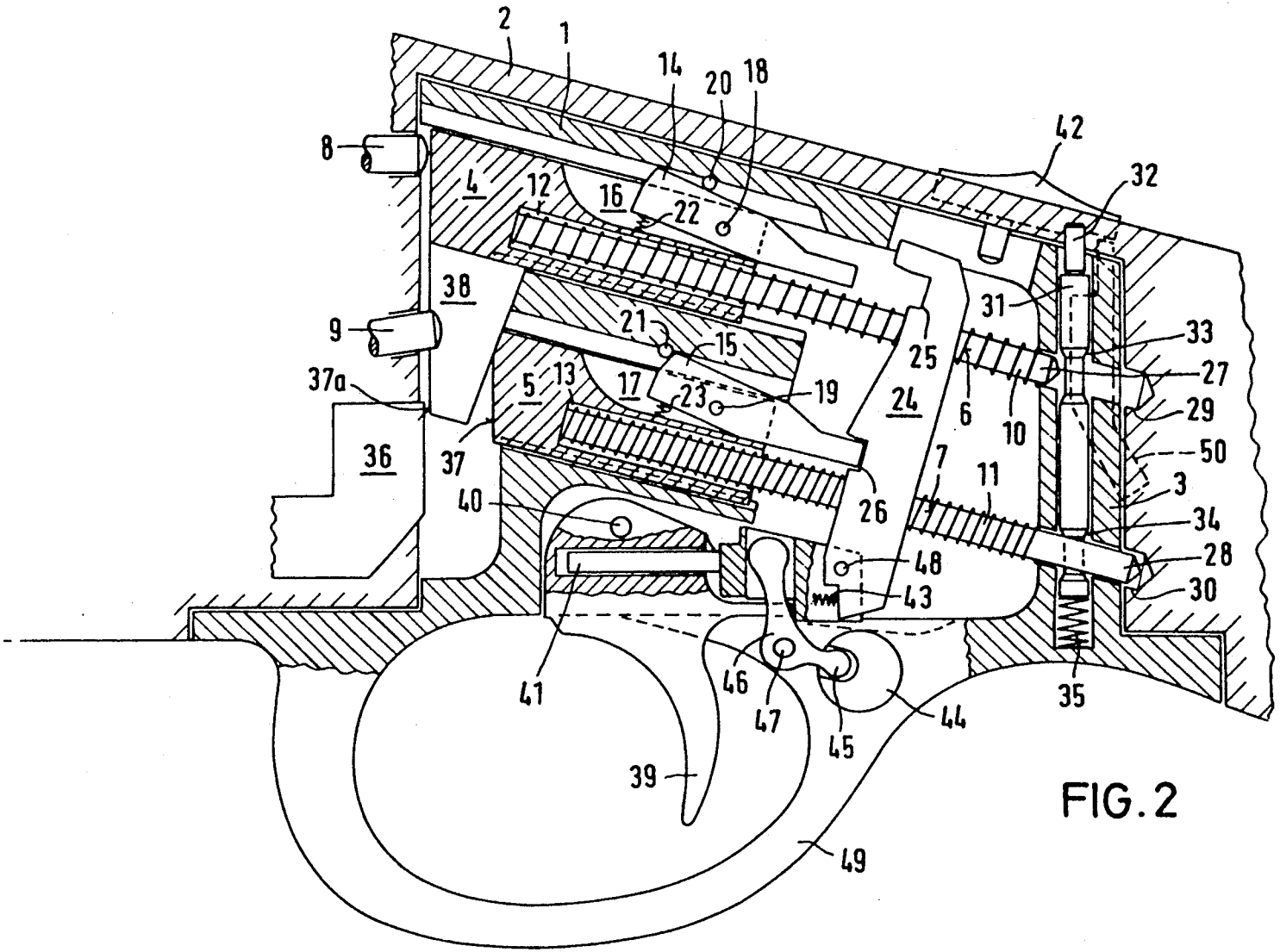
FIG. 2 shows a removable lock housing with the striker for the upper barrel being in the struck position and with the lower barrel being ready for firing.

If the shooter wants triggering of the upper striker 4 to take place first (FIG. 1), then he need merely shift a change-over bolt 44. The movement of the change-over bolt 44 takes place transversely to the plane of the strikers 4, 5. In the change-over bolt 44, a groove with an inclined positioning is provided wherein a spherical head 45 is guided in connection with a change-over rocker 46 in such a way that the change-over rocker 46 is pivoted about a fulcrum 47 during the changeover. In this operation, the longer arm of the change-over rocker 46 rides in a sliding block of the trigger arm 41 and shifts the latter toward the rear. The tumbler weight 24 movable about the fulcrum 48 comes out of engagement with the sear 15 at the detent 26 while the upper detent 25 engages at the tumbler weight 24 in the upper sear 14. Thereby the shooting sequence has been reversed. As soon as the upper striker has struck, the tumbler weight 24 is automatically in engagement with the lower sear 15 (FIG. 2).

If the lock housing 1 is to be removed, it is merely necessary to operate a locking pawl 50 in the rear wall 3 of the breech casing 1. Sensibly, the operation of the spring-stressing locking pawl 50 can take place only in the safety position of the safety slide 42 on the topside of the firearm. During dismounting of the lock housing 1, which is possible only with uncocked strikers, 4, 5, the spring 35 shifts the pressure stud 31 in the axial direction whereby automatically a condition is achieved wherein the strikers 4, 5 cannot be cocked.

A trigger guard 49 is integrally joined to the lock housing 1.

What is claimed is:

1. A sport or hunting firearm comprising at least one barrel, each barrel being associated with a firing pin driven by a striker, a breech casing, a lock housing located within said breech casing, said lock housing containing a triggering arrangement, at least one striker wherein the at least one striker is guided in an axially movable fashion within said lock housing and when several strikers are provided, said strikers are arranged in superimposed relationship within said lock housing, and a cocking device comprising a cocking bar, and a safety device, the at least one striker having, in cross section, an angular, substantially rectangular shape and being accommodated in the lock housing which can be removed from within the breech casing of the firearm; the lock housing fitting in a shape-mating fashion into the breech casing and a locking pawl at the rear wall of the lock housing providing fixed mounting of the lock housing within the breech casing.

2. A sport or hunting firearm comprising at least one barrel, each barrel being associated with a firing pin driven by a striker, a breech casing, a lock housing located within said breech casing, said lock housing containing a triggering arrangement, at least one striker wherein the at least one striker is guided in an axially movable fashion and when several strikers are provided, said strikers are arranged in superposed relationship within said lock housing, and a cocking device comprising a cocking bar, and a safety device, the at least one striker having, in cross section, an angular, substantially rectangular shape and being accommodated within the lock housing which can be removed from the breech casing of the firearm; wherein the lock housing fits in a shape-mating fashion in the breech casing and a locking pawl supported within a rear wall of the lock housing provides fixed mounting of the lock housing; the locking pawl being operated by retraction of a safety slide of the safety device on the firearm.

* * * * *